US005771507A

United States Patent [19]

Healy et al.

[11] Patent Number: 5,771,507

[45] Date of Patent: Jun. 30, 1998

[54] EXTENDIBLE DRAIN CLOSURE DEVICE

[75] Inventors: Patrick E. Healy, Gallitzin; Brian Christopher Schmidt, Johnstown, both of Pa.

[73] Assignee: New Pig Corporation, Tipton, Pa.

[21] Appl. No.: 841,048

[22] Filed: Apr. 29, 1997

[51] Int. Cl.[6] ..... E03C 1/22

[52] U.S. Cl. ..... 4/680; 4/679; 4/651

[58] Field of Search ..... 4/679, 651, 654, 4/680, 687; 210/119

[56] References Cited

U.S. PATENT DOCUMENTS

| | | | |
|---|---|---|---|
| 1,951,632 | 3/1934 | Selimos | 137/78 |
| 1,962,978 | 6/1934 | Baldare | 192/31 |
| 1,982,555 | 11/1934 | Van der Horst | 182/31 |
| 2,008,258 | 7/1935 | Olsen | 182/31 |
| 2,618,356 | 11/1952 | Matheis | 182/31 |
| 2,683,499 | 7/1954 | Croes | 182/1 |
| 2,912,111 | 11/1959 | Kovac, Jr. | 210/119 |
| 2,928,419 | 3/1960 | Kruse | 137/593 |
| 2,944,265 | 7/1960 | Carmichael | 4/680 |
| 3,116,751 | 1/1964 | Hamilton | 4/687 |

*Primary Examiner*—David J. Walczak

*Attorney, Agent, or Firm*—Buchanan Ingersoll, P.C.

[57] ABSTRACT

An extendible drain closure device has a plurality of telescoped hollow tubular members. The outermost hollow tubular member is a main body which has a base portion sized to seat down into a drain opening and an upper flange having a recessed portion. The main body is sized such that the upper flange is flush with the top of the drain opening. Multiple hollow tubular members are positioned within the main body in a telescopically operative manner with the innermost hollow tubular member having a stop ring which seats into the recessed portion of the flange. The top of the extendible drain closure device is thus flush with the top of the drain opening when the device is in a telescopically retracted position. A handle, which can be hinged so that it lies flat when not in use, is provided on the stop ring which may grasped and pulled upwardly to deploy the extendible drain closure device in a telescopically extended position. Each of the multiple hollow tubular members can be provided with a seal ring disposed in an annular groove provided in the outer surface near the bottom opening of each member. In a telescopically extended position, the sealing ring is compressed against the inner surface of an adjacent surrounding hollow tubular member to form a liquid barrier therebetween. A means for releasably maintaining the extendible drain closure device in a telescopically extended position is also provided.

14 Claims, 6 Drawing Sheets

EXTENDIBLE DRAIN CLOSURE DEVICE

FIELD OF THE INVENTION

The invention relates to devices for preventing liquids from flowing into a drainage pipe and more particularly to a device for preventing spilled fluids, which are of a nature such that they should not be permitted to enter a sewer or other drainage system, from flowing into an open floor drain.

BACKGROUND OF THE INVENTION

In many types of industry there is a potential to spill fluids which, because of the nature of the particular fluid, should not be permitted to enter into the sewer or other drainage system. There are many federal and state laws which regulate particulate methods of disposal for certain fluids used in industry. Typically, such fluids cannot be disposed directly into the community's sewage system, but must be collected and disposed of by specifically outlined methods Normally, when unexpected spills of such fluids occur, all nearby drain openings must quickly be plugged or otherwise blocked off until the spill can be contained and cleaned up.

One method of preventing such fluids from entering into open drains is to use a "dike," as it is termed in the industry, to encircle either the spilled liquid or the drain opening. The dike is generally composed of an absorbent material which can soak up the liquid. Alternatively, the dike can be a material which only blocks the liquid and is not absorbent. However, this method may not be entirely satisfactory because some amount of the spilled liquid may reach the drain before the dike can be obtained and positioned. During the time which the dike is being sought and then put into position between the liquid and the drain, the liquid can be continuing to escape into the drain. In such situations the only option may be to plug the drain opening to prevent the additional liquid from escaping. Yet, even after the dike is in place there is normally residual amounts of the liquid around the drain area which must be cleaned up before the drain can be opened.

One device for blocking fluid access to a drain opening is disclosed in U.S. Pat. No. 2,618,356 to Matheis. This device is described as a "water dam" and is utilized to prevent water from entering a roof top drain until the water reaches a certain height. According to Matheis, it has been desirable, in some instances, to flood, or maintain a certain depth of water on, the roof of a building. This device is directed to creating such a condition by preventing water from draining off the roof until it reaches a certain level. This particular device has a base member which is fitted into the drain opening of a roof top and has a second telescoping portion which is slidably received in the base member. The telescoping portion can be drawn up from (or inserted down into) the base member and locked in position at a desired height above the drain opening. The top portion of the telescoping member has openings for the water to enter into the drain after it has reached the desired height. The telescoping portion is retained in the base portion at different heights by use of a pressure ring and multiple lugs which are tightened using wing nuts. First, the telescoping member is drawn upwards (or inserted down into the base member) to a desired height, then the wing nuts are tightened onto lugs which compress the pressure ring causing the ring to frictionally engage the sides of the telescoping member. When the telescoping portion is desired to be lowered into the base member or removed, each of the wing nuts must be loosened to relieve the pressure on the pressure ring such that the telescoping member can again slide freely within the base portion.

A number of other devices for preventing backflow from a drain are disclosed in U.S. Pat. No. 1,982,555 to Van Der Horst, U.S. Pat. No. 2,912,111 to Kovac, Jr., U.S. Pat. No. 1,951,632 to Selimos, U.S. Pat. No. 1,962,978 to Baldare, U.S. Pat. No. 2,008,258 to Olson, U.S. Pat. No. 2,683,499 to De Croes, and U.S. Pat. No. 2,928,419 to Kruse.

The devices disclosed in Van Der Horst and Kovac are self-activating backflow prevention devices having two or more telescoping sections situated in a base member. In each of these devices a float is provided in the uppermost telescoping section which lifts the telescoping sections upwardly as backflow pushes up through the drain pipe and carries the float upwards. The Kovac device discloses is additionally provided with a pressure sensitive valve which prevents any liquid from escaping from the drain until a certain pressure is reached.

The backflow prevention devices disclosed in Selimos, Baldare, Olson, De Croes, and Kruse each disclose devices which screw into or attach onto a floor drain. These devices do not seat flush with the top of the drain when not in use and each has a fixed length which extends a substantial distance upwards from the drain opening when installed.

The self-activating backflow prevention devices disclosed above are not well suited for preventing spills from entering into the drain. These devices are designed to be activated by a backflow coming up through the drain. Thus, in the case of a spill, fluid would easily drain downwardly uninhibited through these devices and into the drainage system without activating the telescoping action.

The remainder of the overflow prevention devices are not particularly well suited to preventing spilled fluids from entering a drain opening in that the devices are not designed to be quickly and easily deployed in case of an unexpected spill. Additionally, these devices each have a fixed length which extends upwards from the drain opening for a substantial distance when installed and can pose a significant obstruction and tripping hazard if the device is left in an installed position. Thus, each of these devices would have to be installed and removed each time it were used.

The water dam disclosed in Matheis is also not particularly well suited to preventing unexpected fluid spills from entering into the drain because like the devices disclosed in Selimos, Baldare, Olson, De Croes, and Kruse, the device is not quickly and easily displayed into an operative position. In the event of a spill the telescoping portion would need to be inserted, or drawn up out of the base portion, at the necessary height and then held there while several wing nuts are tightened in order to both seal the gap between the telescoping portions and the base portion and also to retain the telescoping portion at the desired height.

Therefore, there is an need for an extendible drain closure device which can be installed in a flush condition with the top of the drain and still be quickly deployed into an operative position in the event of an unexpected spill.

SUMMARY

According to the present invention an extendible drain closure device is provided having multiple telescoping hollow tubular members. The outer most telescoping member forms a main body and is sized to seat down into a drain opening and has a top flange member which is generally flush with the top of the drain opening. Multiple hollow tubular members are disposed within the main body in a telescopically operative arrangement. The innermost telescoping member can have a stop ring attached to the top edge which is sized to seat into a recess that can be provided in the flange on the main body such that the stop ring is flush with the top of the flange member. The stop ring can also be provided with a handle that can be hinged to the top surface of the stop ring such that the handle can lie flat and can be pulled upwards in order to deploy the extendible drain closure device in a telescopically extended position. Also an annular groove can be provided in the outside surface near the bottom opening of each of the inner telescoping tubular members. A seal ring can be provided in the annular groove to create a liquid barrier between the outside surface of each inner telescoping tubular member and the inside surface of each of the surrounding adjacent telescoping tubular members and the main body when the tubular members are telescopically extended. A retainer can preferably be provided across the bottom opening of the main body in order to prevent the inner telescoping tubular members from falling down through the bottom opening of the main body. This retainer can be a cross-bar which is fixed across the bottom opening of the main body or can be a number of radially spaced tabs protruding inwardly from the edge of the bottom opening of the main body. The tabs extend inwardly far enough that the bottom cylindrical edges of each of the inner telescoping tubular members abut against the tabs so that they cannot fall downwards through the bottom opening of the main body.

A means for releasably maintaining the extendible drain closure device in a telescopically extended position is also provided. This means can preferably be accomplished using hollow, conical-shaped, tubular telescoping members which are tapered from a larger bottom opening to a smaller top opening. When the multiple telescoping members are pulled upwards, the larger bottom opening of an inner telescoping member frictionally engages the smaller top opening of an adjacent outer telescoping member. The telescoping members may be released from the extended position by pressing downwards on the upper-most telescoping member with enough force to overcome the friction thereby releasing the telescoping members from an extended position and returning the telescoping members to a retracted position flush with the top of the drain opening. Thus, the extendible drain closure device can remain in an installed, ready to be deployed, condition that is generally flush with the top of the drain opening so as not to pose an obstruction or tripping hazard.

Other details, objects and advantages of the invention will be become apparent from the following description and the accompanying drawings of certain embodiments thereof.

BRIEF DESCRIPTION OF THE DRAWING FIGURES

In the accompanying drawing figures, certain preferred embodiments of the invention are illustrated in which.

DETAILED DESCRIPTION

Figure 1:
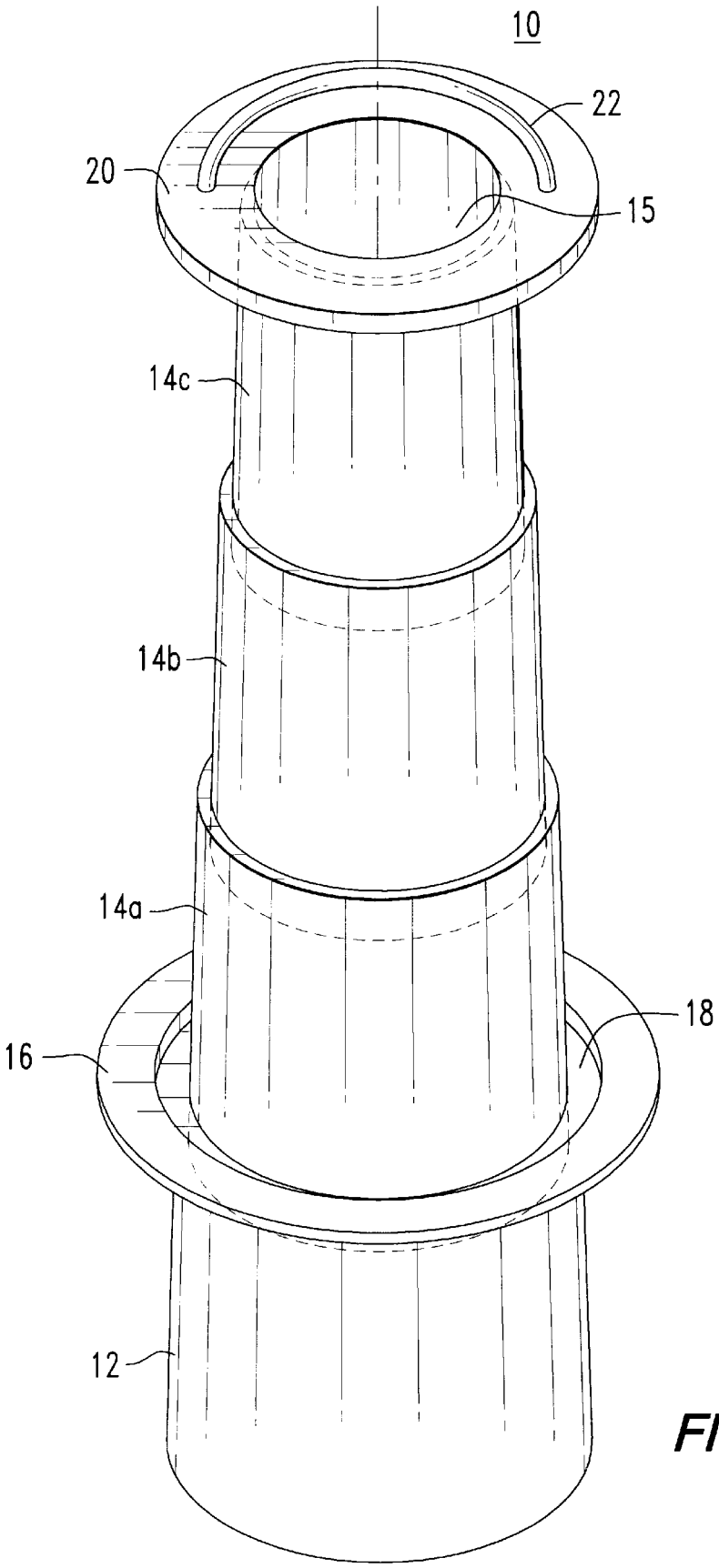
FIG. 1 is a perspective view of an embodiment of the invention shown in an extended position.
Figure 2:
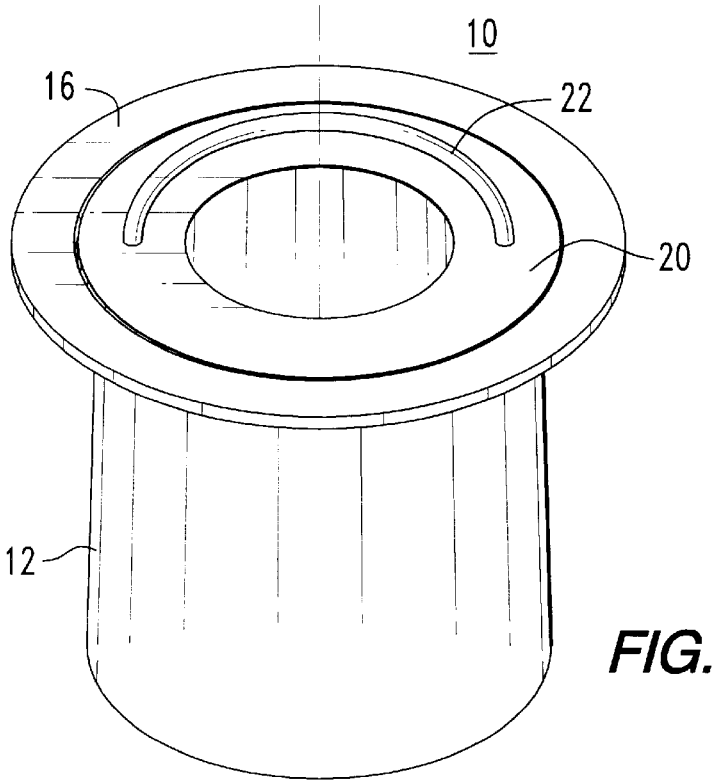
FIG. 2 is a perspective view of an embodiment of the invention shown in an unextended position.
Figure 3:
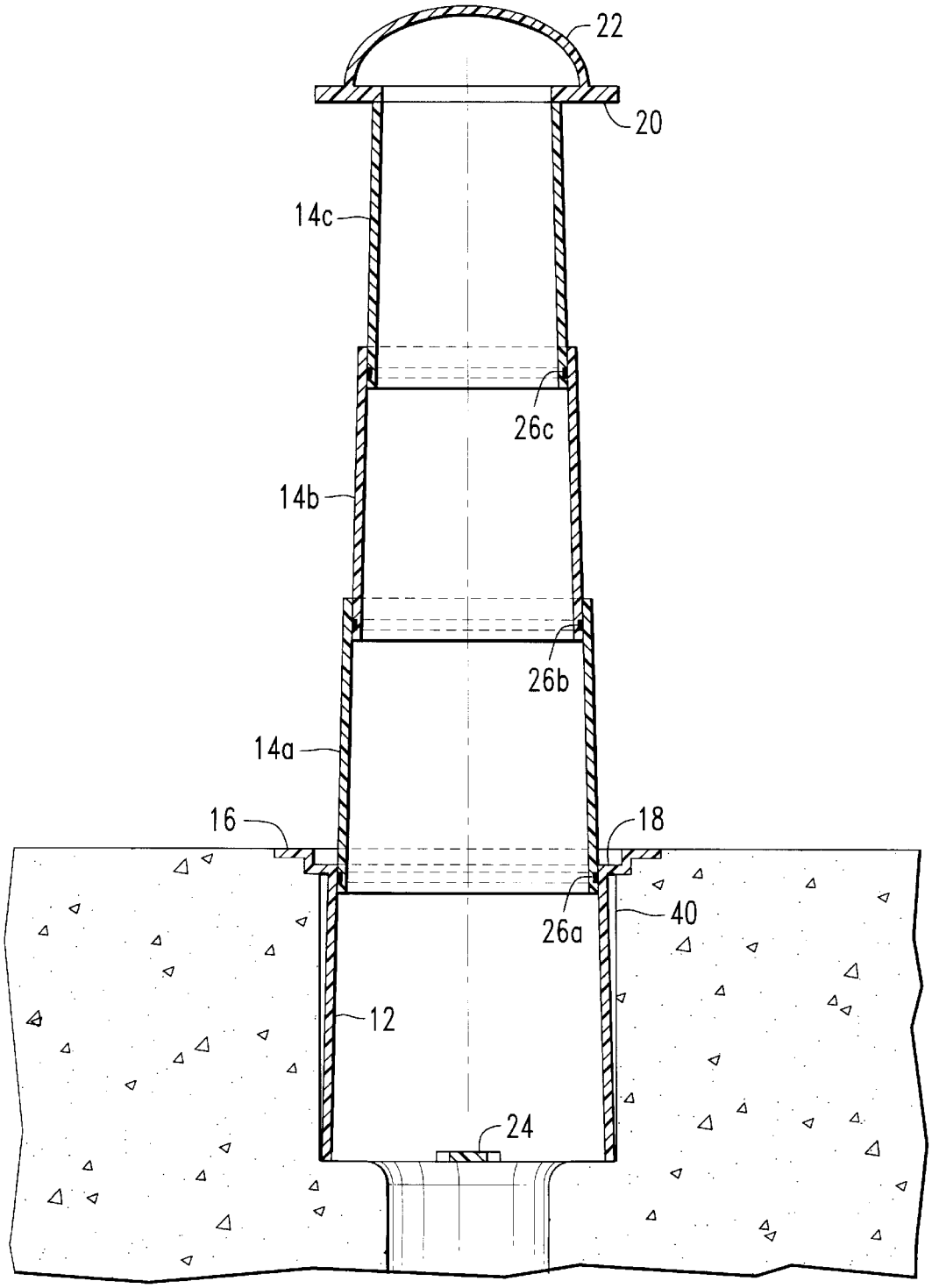
FIG. 3 is a cross section of a side view of an embodiment of the invention seated in a drain opening and deployed in a telescopically extended position.

Referring now to the drawing figures wherein like reference numbers refer to similar parts throughout the several views, an embodiment of an extendible drain closure device is shown in FIGS. 1 and 3. The drain closure device 10 is shown in a telescopically extended configuration in FIG. 1 and has a main body 12 having a flange 16 at the top with a recessed portion 18 in the surface thereof, a plurality of hollow tubular members 14*a*–14*c* disposed in the main body 12 in a telescopically operative manner, a stop ring 20 attached to the uppermost tubular telescoping member 14*c*, and a handle 22 attached to the stop ring 20. The main body 12 is sized to fit into a drain opening, as shown in FIG. 3, such that the flange portion 16 is flush with the top of the drain opening. The opening 15 in the top of the innermost tubular telescoping member 14*c* provides access to the drain opening 40. The stop ring 20 is sized to fit into the recessed portion 18 of the flange 16 flush with the top surface of the flange 16. Thus, when the drain closure device 10 is in a retracted position in the drain opening the top of the drain closure device 10 is generally flush with the top of the drain opening, as shown in FIG. 2.

In operation, the drain closure device 10 functions as a normal floor level drain permitting fluids to enter the drain opening through the opening 15 in the innermost tubular telescoping member 14*c* which is generally flush with the top of the drain opening. In the case of an inadvertent spill, the handle 22 attached to the stop ring 20 is grasped and drawn forcefully upwards to deploy the tubular telescoping members 14*a* through 14*c* in a telescopically extended position. Deployed in this extended position the drain opening 15 in the top of the innermost telescoping member 14*c* is elevated some distance above the floor such that the spilled liquid cannot enter into the drain, at least until the fluid rises to above the innermost tubular telescoping member 14*c*.

Figure 6:
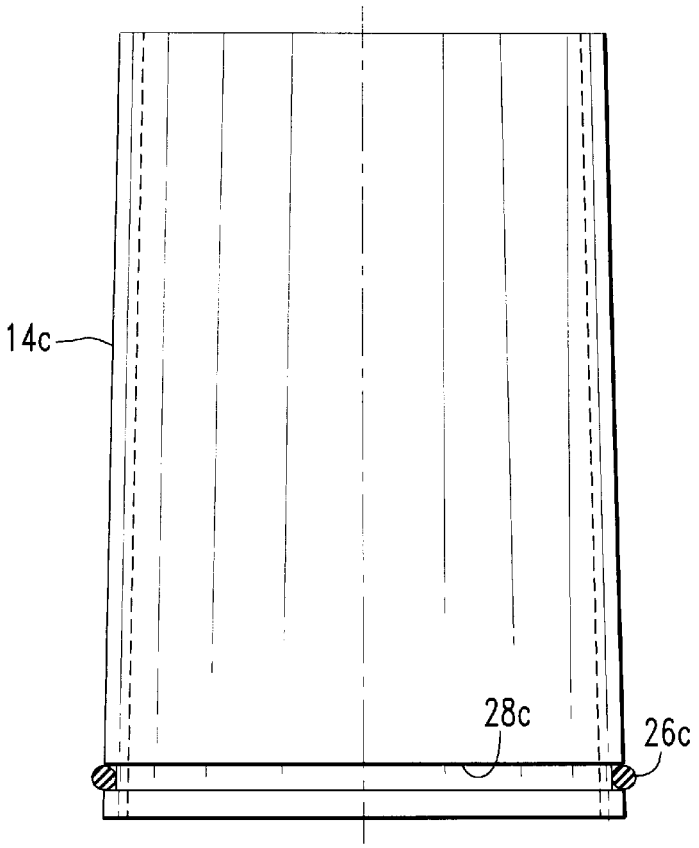
FIG. 6 is a side view of one other of the multiple telescoping tubular members of an embodiment of the invention.
Figure 5:
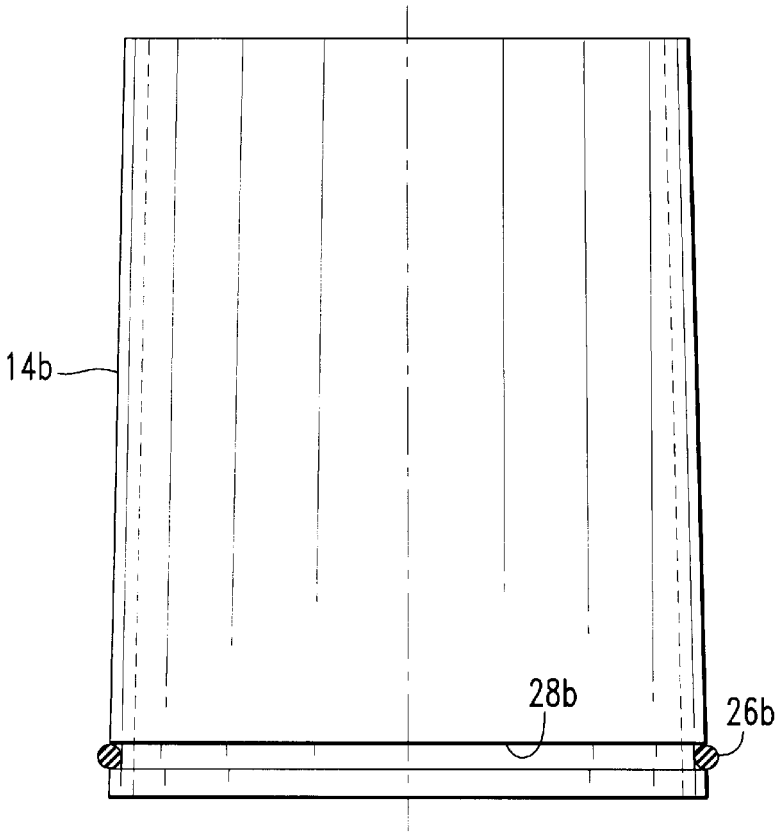
FIG. 5 is a side view of one other of the multiple telescoping tubular members of an embodiment of the invention.
Figure 4:
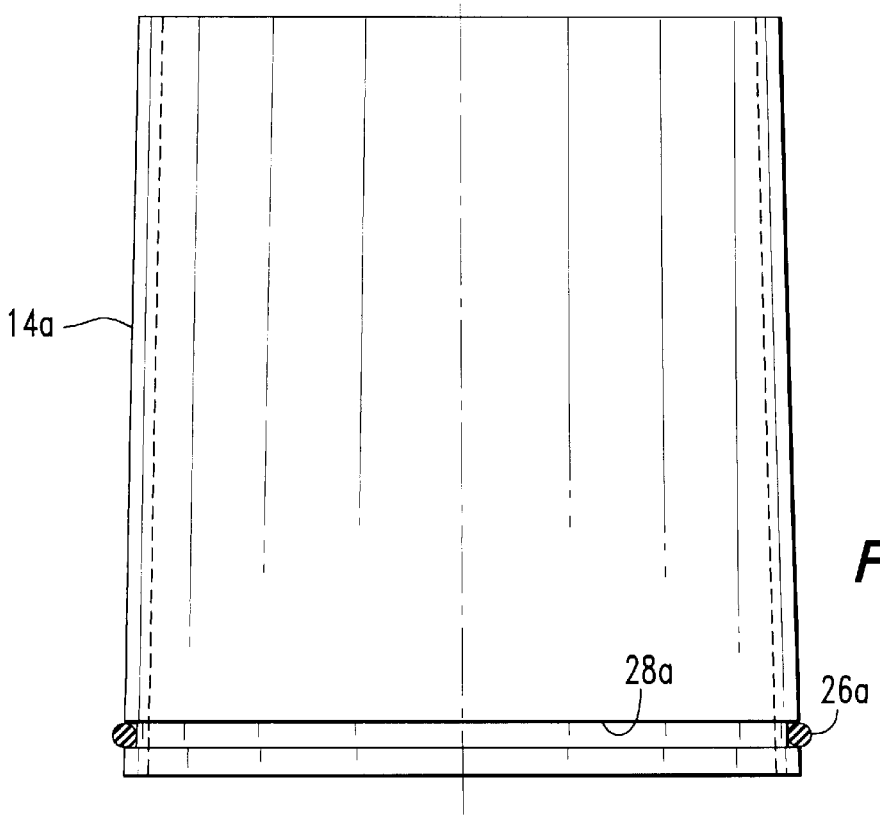
FIG. 4 is a side view of one of the multiple telescoping tubular members of an embodiment of the invention.

Each of the tubular telescoping members 14*a*–14*c* is provided with an annular groove 28*a*–28*c* near the bottom cylindrical edge of each member, as shown best in FIGS. 4–6. A sealing ring 26*a*–26*c* is disposed in each annular groove 28*a*–28*c*. The sealing rings 26*a*–26*c* provide a barrier between the outside surface of tubular telescoping members 14*a*–14*c* and an adjacent inside surface of each tubular telescoping members 14*a*, 14*b*, and main body 12 when the drain closure device 10 is deployed in a telescopically extended position as shown in FIG. 3. The seal rings 26*a*–26*c* thus prevent fluid from escaping into the drain opening between adjacent surfaces of the main body 12 and the individual tubular telescoping members 14*a*–14*c*.

The telescoping tubular members 14*a*–14*c* preferably can each be conical shaped, being tapered from a larger bottom opening to a smaller top opening. Each telescoping tubular member being slightly smaller than an adjacent outer telescoping tubular member, or the main body 12 with respect to tubular member 14*a*. In this manner the tubular members 14*a*–14*c* telescope within the main body 12. At the most extended telescoped position, shown best in FIG. 3, the larger bottom opening of each telescoping tubular member 14*a*–14*c* frictionally engages the smaller top opening of an outer adjacent tubular telescoping member, with the outer telescoping tubular member 14*a* frictionally engaging the top opening of the main body 12. The drain closure device 10 in this embodiment is retained in the extended position by the frictional engagement just described. To close the drain closure device 10, force is applied to the stop ring 20 and, or, the handle 22 to overcome the friction and return the tubular telescoped members 14*a*–14*c* to a telescopically retracted position within the main body 12. Annular grooves 28*a*–28*c*, and sealing rings 26*a*–26*c* disposed therein, can also be provided which create a liquid barrier between each tubular telescoping member and also enhance the frictional engagement and release operation of the drain closure device 10. Alternatively, however, other satisfactory means known by those skilled in the art may be employed in order to releasably retain the telescoping tubular member in an extended position.

Figure 7:
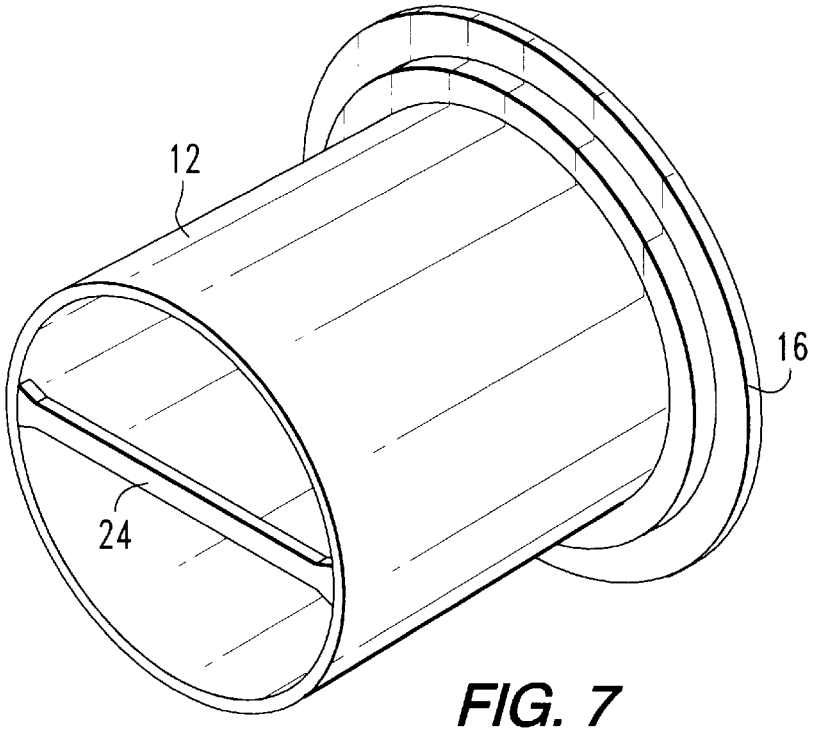
FIG. 7 is a perspective view showing an embodiment of the invention having a lower retainer.
Figure 8:
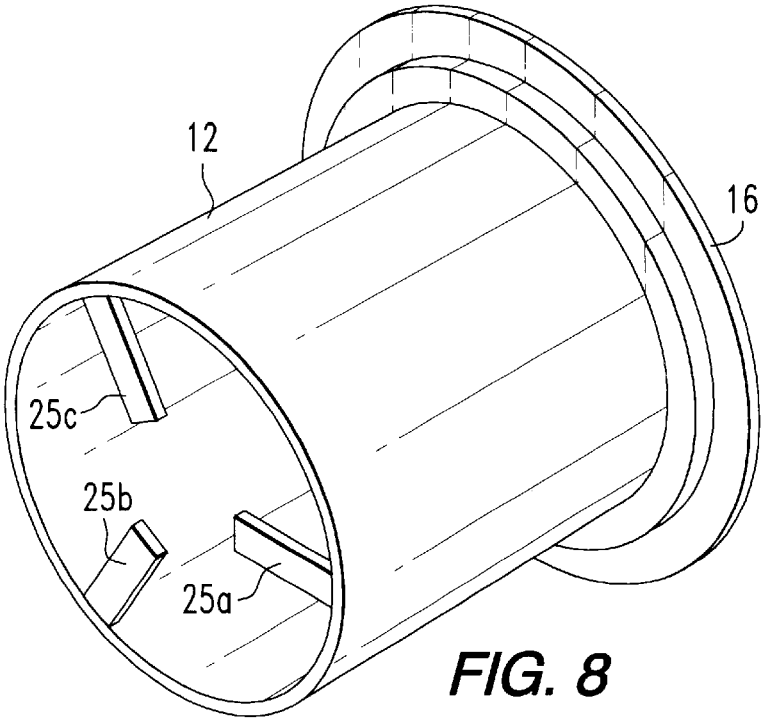
FIG. 8 is a perspective view of an alternative type of lower retainer.

The main body 12 can further be provided with a retainer 24 at the base of the main body 12, as shown best in FIGS. 7 and 8. The retainer 24 can be the crossbar 24 shown in FIG. 7 which is attached at either end across the bottom opening of the base member 12 such that the inner tubular telescoping members 14*a*–14*c* cannot drop downwards through the bottom of the main body 12. Alternatively, a plurality of tabs 25*a*–25*c*, shown in FIG. 8, can be provided around edge of the bottom opening of the main body 12. The tabs 25*a*–25*c* extend inwardly to prevent the inner tubular telescoping members 14*a*–14*c* from dropping downwards through the bottom of the main body 12.

Figure 9:
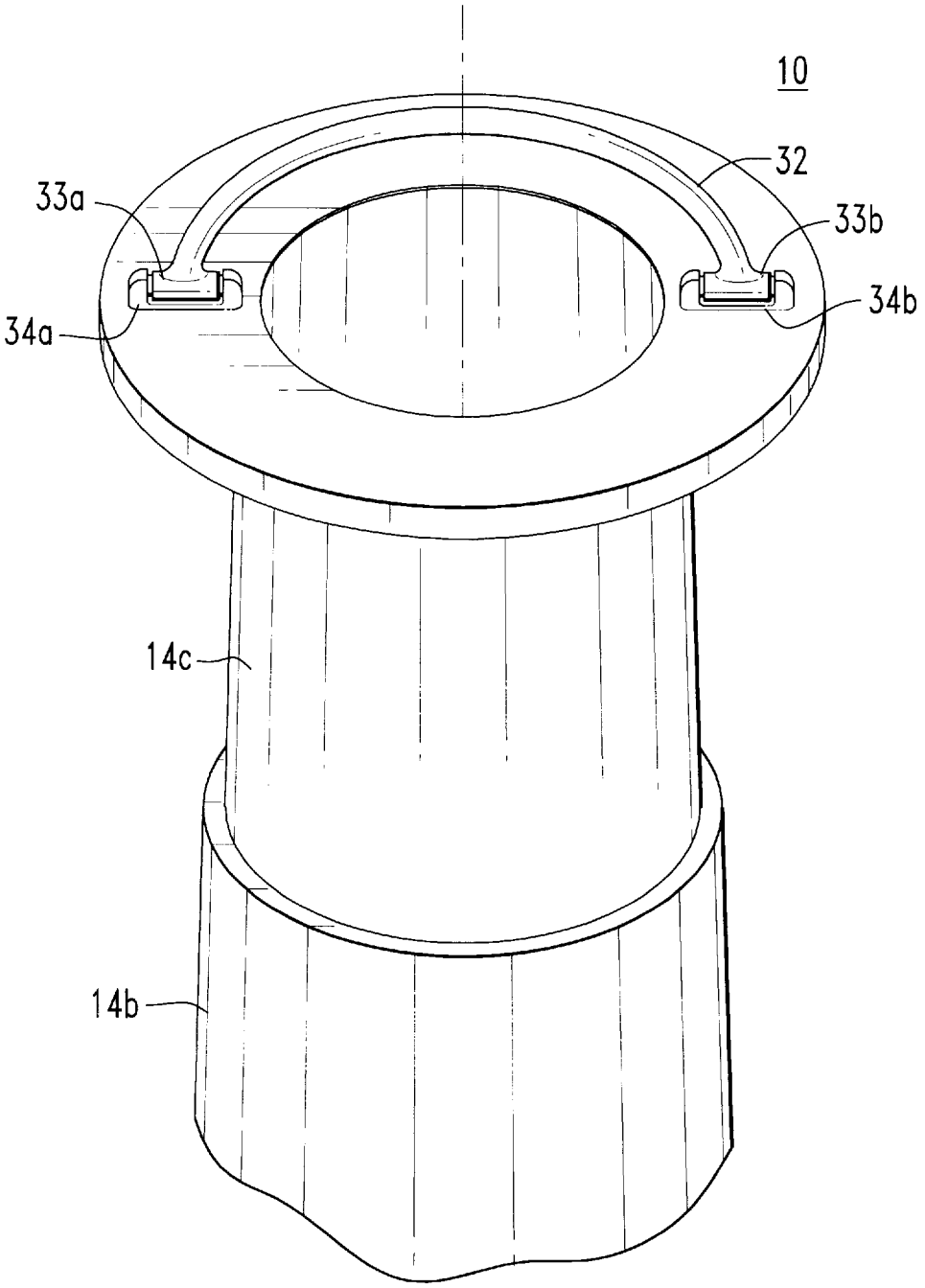
FIG. 9 is a perspective view of an alternative handle for an embodiment the present invention.

As an alternative to the fixed handle 22, a hinged handle 32 is illustrated in FIG. 9. The handle 32 is hinged at ends 33*a* and 33*b* to mounting points 34*a* and 34*b* on the top surface of the stop ring 20. The hinged handle 32 can thereby lie flat against the stop ring 20 until it is picked up and grasped in order to deploy the extendible drain closure device 10 in a telescopically extended position. A hinged handle 32 lies flat to avoid presenting any obstruction to persons or vehicles, such as carts.

While specific embodiments of the invention have described in detail, it will be appreciated by those skilled in the art that various modifications and details to those details could be developed in light of the overall teachings of the disclosure. Accordingly, the particular embodiments disclosed herein is intended to be illustrated only and not limiting to the scope of the invention and should be awarded the full breadth of the following claims and any and all embodiments thereof.

What is claimed is:

1. An extendible drain closure device comprising:

(a) hollow tubular main body having a top opening and a bottom opening and a flange on said top opening, said flange having a top surface and a recessed portion in said top surface, said main body being sized to seat in a drain opening with the top surface of the flange flush with a surface in which the drain opening is formed;

(b) a plurality of hollow tubular members disposed within said main body in a telescopically operative manner, said hollow tubular members having a top opening and a bottom opening;

(c) a stop ring on the top opening of an innermost one of said plurality of telescoped members, said stop ring sized to seat in said recessed portion flush with said top surface when said plurality of hollow tubular members are in a telescopically retracted position within the main body;

(d) a handle attached to said stop ring for pulling said plurality of hollow tubular members upwards to deploy said extendible drain closure device into a telescopically extended position; and (e) means for releasably maintaining the extendible drain closure device in said telescopically extended position.

2. The extendible drain closure device of claim 1 further comprising a retainer attached to a bottom opening of the main body to prevent the plurality of hollow tubular members disposed within the main body from dropping down past the bottom opening.

3. The extendible drain closure device of claim 2 wherein said retainer is a crossbar attached across said bottom opening.

4. The extendible drain closure device of claim 2 wherein said retainer is a plurality of tabs positioned at radially spaced apart locations on an inside surface at the bottom opening of the main body, said tabs protruding inwardly from said inside surface and abutting against the bottom opening of inner ones of said plurality of telescoped members when the extendible drain closure device is in a telescopically retracted position.

5. The extendible drain closure device of claim 1 wherein said handle is hinged to said stop ring.

6. The extendible drain closure device of claim 1 wherein said main body and each of said plurality of hollow tubular members is tapered and the top opening slightly smaller than the bottom opening of an adjacent inner one of said plurality of hollow tubular members and wherein said means for releasably maintaining the extendible drain closure device in a telescopically extended position comprises pulling upwards forcefully using said handle to telescopically extend said plurality of hollow tubular members to cause an outer surface of the slightly larger bottom opening of each of said plurality of hollow tubular members to frictionally engage an inner surface of the slightly smaller top opening of an adjacent one of each of said plurality of hollow tubular members and hold each of the plurality hollow tubular members in a telescopically extended position, said telescopically extended position released by exerting force on the stop ring to overcome the friction between said outer and inner surfaces and return the plurality of hollow tubular members to a telescopically retracted position.

7. The extendible drain closure device of claim 6 further comprising:

(a) the outer surface of each inner one of said plurality of hollow tubular members having an annular groove therein located near the bottom opening thereof; and (b) a seal ring disposed in said annular groove, said seal ring creating a fluid barrier between the inner surface and the outer surface of adjacent ones of the plurality of hollow tubular members when the plurality of hollow tubular members are telescopically extended and the surfaces are caused to be frictionally engaged.

8. The extendible drain closure device of claim 6 further comprising a retainer at the bottom opening of the main body to prevent inner ones of the plurality of hollow tubular members from extending downward past the bottom opening of the main body.

9. The extendible drain closure device of claim 8 wherein said retainer is a crossbar attached across the bottom opening of the main body.

10. The extendible drain closure device of claim 8 wherein said retainer is a plurality of tabs positioned at radially spaced apart locations on an inside surface of the bottom opening of the main body, said tabs protruding inwardly from the bottom opening and abutting the bottom opening of each of the inner ones of said plurality of hollow tubular members when the extendible drain closure device is in a telescopically retracted position.

11. An extendible drain closure device comprising:

(a) a tapered hollow tubular main body having an inner surface, a base portion, and a top opening, said base portion having a bottom opening and being sized to seat into a drain opening, said top opening having a flange member attached thereto, said flange member being flush with the surface in which the drain opening is formed, said flange member also having a top surface and a recessed portion in said top surface;

(b) a plurality of tapered hollow tubular members disposed inside the main body in a telescopically operative manner, each of said plurality of hollow tubular members having a top opening adjacent the top opening of the main body and a bottom opening adjacent the bottom opening of the base portion when each of said plurality of telescoping members is in a telescopically retracted position, each of said plurality of hollow tubular members sized to slidably surround adjacent inner ones of said plurality of hollow tubular members in a telescopically operative manner, the bottom opening of each of said plurality of hollow tubular members being slightly larger than the top opening of an adjacent surrounding one of said plurality of hollow tubular members, each of said plurality of hollow tubular members having an outer surface and an inner surface, said outer surface having an annular notch therein located near said bottom opening and a seal ring disposed in said annular notch, said seal ring forming a liquid barrier between said outer surface and one of the inner surface of an adjacent one of said plurality of hollow tubular members and the inner surface of the main body;

(c) a stop ring attached to the top opening of an innermost one of the plurality of hollow tubular members, said stop ring being sized to seat in said recessed portion flush with the top surface of the flange member;

(d) a handle attached to the stop ring for pulling said plurality of hollow tubular members upwardly to deploy the extendible drain closure device in a telescopically extended position; and (e) a retainer attached to the base portion to prevent said plurality of hollow tubular members inside the main body from falling down through the bottom opening of the base portion.

12. The extendible drain closure device of claim 11 wherein said retainer is a crossbar attached to the base portion across the bottom opening.

13. The extendible drain closure device of claim 11 wherein said retainer is a plurality of tabs positioned at radially spaced apart locations on the inner surface of the base portion at the bottom opening, said tabs protruding inwardly from the inner surface and abutting against the bottom opening of each of the plurality of hollow tubular members when the extendible drain closure device is in a telescopically retracted position.

14. The extendible drain closure device of claim 11 wherein said handle is hinged to the stop ring.

* * * * *